US012286977B2

(12) United States Patent
Hayashi et al.

(10) Patent No.: US 12,286,977 B2
(45) Date of Patent: Apr. 29, 2025

(54) SCROLL CASING OF CENTRIFUGAL FAN, CENTRIFUGAL FAN, AIR-CONDITIONING APPARATUS AND REFRIGERATION CYCLE APPARATUS INCLUDING THE SCROLL CASING

(71) Applicant: Mitsubishi Electric Corporation, Tokyo (JP)

(72) Inventors: Hiroyasu Hayashi, Tokyo (JP); Takuya Teramoto, Tokyo (JP); Takahiro Yamatani, Tokyo (JP); Tomohiro Nagano, Tokyo (JP); Yuki Hara, Tokyo (JP); Ryo Horie, Tokyo (JP); Takashi Yamaguchi, Tokyo (JP); Kota Nagano, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 182 days.

(21) Appl. No.: 18/001,606

(22) PCT Filed: Jul. 29, 2020

(86) PCT No.: PCT/JP2020/029089
§ 371 (c)(1),
(2) Date: Dec. 13, 2022

(87) PCT Pub. No.: WO2022/024267
PCT Pub. Date: Feb. 3, 2022

(65) Prior Publication Data

US 2023/0228280 A1 Jul. 20, 2023

(51) Int. Cl.

| | |
|---|---|
| ***F04D 29/42*** | (2006.01) |
| ***F04D 17/08*** | (2006.01) |
| ***F25D 17/06*** | (2006.01) |

(52) U.S. Cl.
CPC ..... *F04D 29/4226* (2013.01); *F04D 17/08* (2013.01); *F25D 17/067* (2013.01)

(58) Field of Classification Search
CPC ..... F04D 29/4226; F04D 17/08; F04D 17/16; F04D 29/626; F04D 29/602;
(Continued)

(56) References Cited

U.S. PATENT DOCUMENTS

| | | | | |
|---|---|---|---|---|
| 2007/0116559 | A1* | 5/2007 | Higashida | F24F 1/0047 415/206 |
| 2019/0242612 | A1 | 8/2019 | Teramoto et al. | |
| 2022/0106968 | A1 | 4/2022 | Teramoto et al. | |

FOREIGN PATENT DOCUMENTS

| | | | |
|---|---|---|---|
| CN | 104564828 A | * | 4/2015 |
| CN | 103216925 B | | 3/2016 |

(Continued)

OTHER PUBLICATIONS

Examination Report dated Apr. 11, 2023 issued in corresponding IN Patent Application No. 202327000139.

(Continued)

*Primary Examiner* — Woody A Lee, Jr.
*Assistant Examiner* — Eric A Lange
(74) *Attorney, Agent, or Firm* — Posz Law Group, PLC

(57) ABSTRACT

A scroll casing has a scroll portion, a discharge portion provided with a discharge port, and a tongue portion. An extended plate has, in a cross section obtained by cutting in a thickness direction, a change point, at which an enlargement ratio of an area of the cross section is enlarged so as to be larger on a downstream side than that on an upstream side due to a change of inclination. In the extended plate, an angle θ1, and an angle θ2 satisfy a relationship of either $0 \leq \theta 2 < \theta 1$ or $0 < \theta 2 \leq \theta 1$. A distance L1 and a distance L2 satisfy a relationship of L2<L1.

2 Claims, 7 Drawing Sheets

(58) Field of Classification Search
CPC .... F04D 29/441; F25D 17/067; F24F 1/0022; F05D 2250/52
See application file for complete search history.

(56) References Cited

FOREIGN PATENT DOCUMENTS

| | | | | | |
|---|---|---|---|---|---|
| JP | H06-058564 | A | 3/1994 | | |
| JP | H10-299697 | A | 11/1998 | | |
| JP | H11-91334 | A | 4/1999 | | |
| JP | H11-324993 | A | 11/1999 | | |
| JP | 2004-360579 | A | 12/2004 | | |
| JP | 2005-069177 | A | 3/2005 | | |
| KR | 10-1841953 | B1 | 3/2018 | | |
| WO | WO-2018079776 | A1 * | 5/2018 | ..... | F04D 29/44 |
| WO | 2019/082949 | A1 | 5/2019 | | |

OTHER PUBLICATIONS

Hearing Notice dated Dec. 14, 2023 issued in corresponding IN Patent Application No. 202327000139.
Office Action dated Jun. 2, 2021 issued in corresponding TW Patent Application No. 11020522560 (and English machine translation).
International Search Report of the International Searching Authority mailed Sep. 1, 2020 for the corresponding International application No. PCT/JP2020/029089 (and English translation).
Extended European Search Report dated Aug. 21, 2023 issued in corresponding European patent application No. 20947659.7.
Office Action dated Jan. 24, 2025 issued in corresponding CN patent application No. 202080104609.7 (and English translation).

* cited by examiner

SCROLL CASING OF CENTRIFUGAL FAN, CENTRIFUGAL FAN, AIR-CONDITIONING APPARATUS AND REFRIGERATION CYCLE APPARATUS INCLUDING THE SCROLL CASING

CROSS REFERENCE TO RELATED APPLICATION

This application is a U.S. national stage application of PCT/JP2020/029089 filed on Jul. 29, 2020 the contents of which are incorporated herein by reference.

TECHNICAL FIELD

The present disclosure relates to a scroll casing that accommodates a fan, a centrifugal fan provided with this scroll casing, an air-conditioning apparatus and a refrigeration cycle apparatus each including this scroll casing.

BACKGROUND ART

Some related-art air conditioning apparatuses have, between an air inlet and an air outlet, a heat exchanger and a centrifugal fan provided with a scroll casing. In such an air-conditioning apparatus, a fan accommodated in the scroll casing rotates to cause air drawn in from the air inlet of the air-conditioning apparatus to flow into the fan along the bell mouth that forms a suction port of the scroll casing. The airflow discharged from the fan is subjected to pressure rising in the scroll casing, discharged from a discharge port of the scroll casing, passes through the heat exchanger, and then blown out from the air outlet of the air-conditioning apparatus into a space to be air-conditioned (see Patent Literature 1, for example).

CITATION LIST

Patent Literature

Patent Literature 1: Japanese Unexamined Patent Application Publication No. 2005-69177

SUMMARY OF INVENTION

Technical Problem

The scroll casing installed in an air-conditioning apparatus with such a configuration suffers from insufficient rising in pressure of airflow since it is impossible to sufficiently enlarge the discharge port due to structural restrictions inside the apparatus. In addition, such inability to sufficiently enlarge the discharge port limits a range of passage of the airflow discharged from the discharge port when it passes through the heat exchanger. Therefore, if the scroll casing tilts or the like for some reasons and, as a result, the direction of the discharge port of the airflow changes, the airflow cannot pass through some areas of the heat exchanger, whereby a drift flow occurs. Such a drift flow may result in inefficient heat exchange.

For an air-conditioning apparatus, there is a need to improve the workability in assembling a centrifugal fan into a housing of the air-conditioning apparatus, and under such circumstances, a scroll casing having a configuration that can achieve this improvement in workability has been required.

The present disclosure has been made to solve the above-mentioned problems and an object thereof is to obtain a scroll casing capable of attaining a pressure rising effect and a drift flow suppression effect, and also can improve workability in assembly, as well as to obtain a centrifugal fan, an air-conditioning apparatus and a refrigeration cycle apparatus provided with the scroll casing.

Solution to Problem

The scroll casing for a centrifugal fan according to the present disclosure includes a fan configured to generate airflow, the scroll casing comprising: a scroll portion configured to accommodate the fan and guide an airflow generated by the fan in a spiral shape; a discharge portion provided at a winding end portion of the scroll portion and having a discharge port configured to cause airflow to be discharged; and a tongue portion provided at a part connecting a winding start portion of the scroll portion and the discharge portion, wherein the discharge portion forms a flow passage of which an area of a cross section crossing orthogonally to a flow direction of the airflow gradually enlarges toward the discharge port, an extended plate formed so as to extend from the winding end portion in the discharge portion is, in a cross section obtained by cutting the extended plate in a thickness direction thereof, inclined relative to an inner wall surface of a housing configured to accommodate the centrifugal fan, and the extended plate has a change point at which an enlargement ratio of the area of the cross section on a downstream side is increased so as to be larger than that on an upstream side due to a change in degree of inclination, and wherein, when a portion on the upstream side than the change point is named as a first portion and a portion on the downstream side than the change point is named as a second portion, an angle $\theta 1$ and an angle $\theta 2$ satisfy a relationship of either $0 \leq \theta 2 < \theta 1$ or $0 < \theta 2 \leq \theta 1$, where $\theta 1$ is defined by the first portion and a virtual line that is parallel to the inner wall surface of the housing and passes the change point, and the angle $\theta 2$ is defined by the second portion and the virtual line, and a distance L1 and a distance L2 satisfy a relationship of $L2 < L1$, where L1 is a distance in a direction parallel to the virtual line between an end portion on the upstream side of the tongue portion and the change point and the distance L2 is a distance in a direction parallel to the virtual line between the change point and an end portion on the downstream side of the second portion.

Advantageous Effects of Invention

According to the present disclosure, since the angle $\theta 1$ and the angle $\theta 2$ satisfy a relationship of either $0 \leq \theta 2 < \theta 1$ or $0 < \theta 2 \leq \theta 1$, the pressure rising effect and the drift flow suppression effect can be obtained. Further, since the distance L1 and the distance L2 satisfy a relationship of $L2 < L1$, workability in assembly is improved.

DESCRIPTION OF EMBODIMENTS

Hereinbelow, an air-conditioning apparatus in which a centrifugal fan with a scroll casing according to embodiments of the present disclosure is incorporated will be described with reference to the drawings, and other materials. In the following drawings, including FIG. 1, the relative dimensional relationship of the components, the shape of each component may differ from the actual ones. In the following drawings, the components with the same symbols are the same or equivalent, and this is applied to the entire description. In addition, for ease of understanding, terms indicating direction (e.g., "up", "down", etc.) are used as appropriate, but they are used only for convenience of explanation and are not intended to restrict the arrangement or orientation of devices or parts.

Embodiment 1

Figure 1:
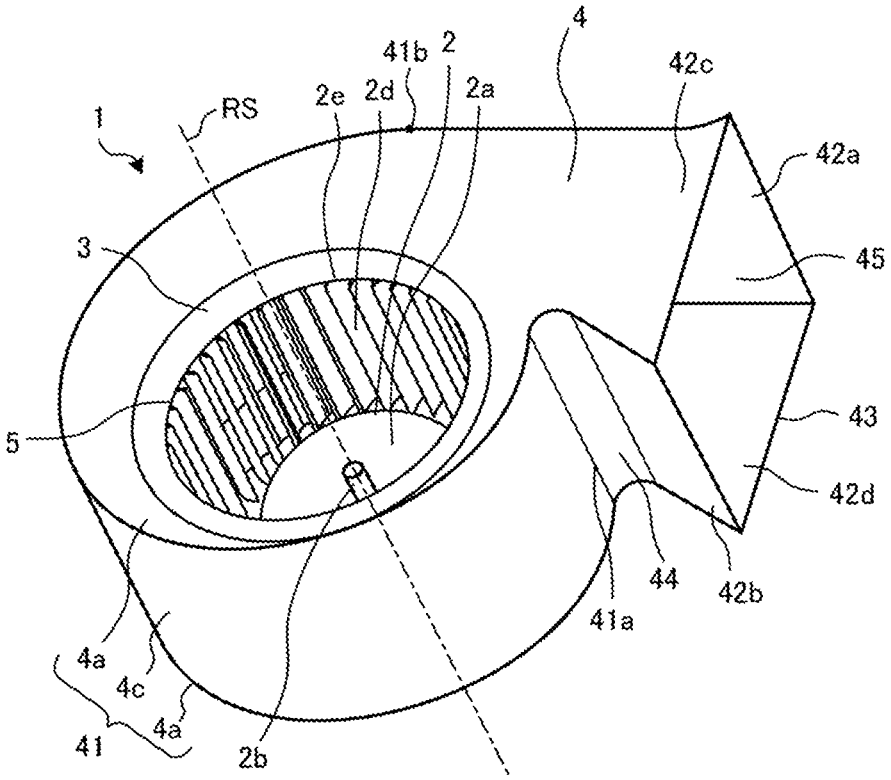
FIG. 1 shows a perspective view of the centrifugal fan according to Embodiment 1.
Figure 2:
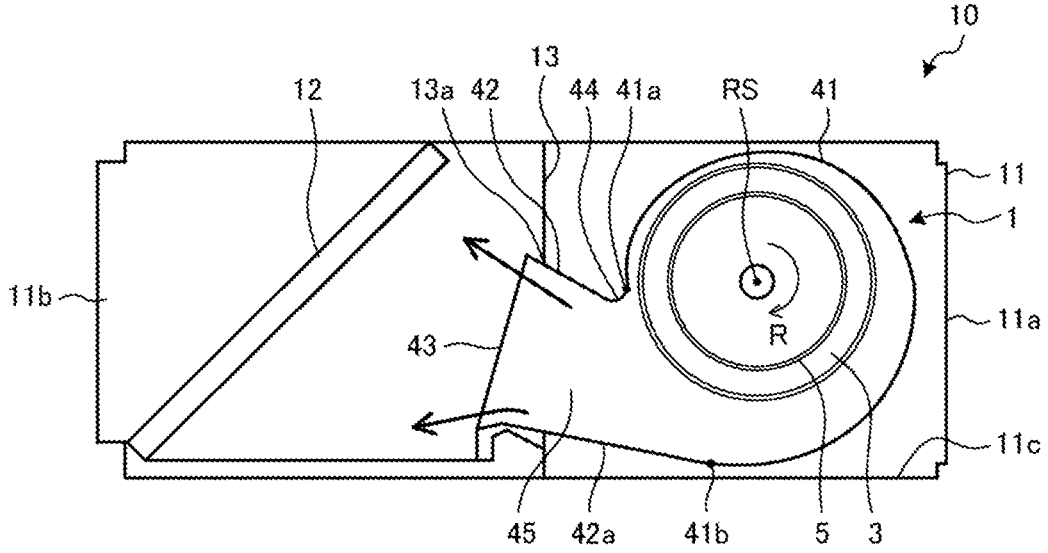
FIG. 2 is a schematic side view of an internal configuration of an air-conditioning apparatus provided with the centrifugal fan according to Embodiment 1.

FIG. 1 is a perspective view of the centrifugal fan according to Embodiment 1. FIG. 2 is a schematic side view of an internal configuration of the air-conditioning apparatus provided with the centrifugal fan according to Embodiment 1.

A centrifugal fan 1 is a multi-blade centrifugal fan, such as a sirocco fan or a turbo fan. The centrifugal fan 1 has a fan 2 that generates airflow and a scroll casing 4 that accommodates the fan 2. The centrifugal fan 1 is arranged inside a cuboid-shaped housing 11 of an air-conditioning apparatus 10, as illustrated in FIG. 2. The housing 11 is divided into two spaces by a partition plate 13, and a heat exchanger 12 is installed in another space, which is separate from a space where the centrifugal fan 1 is installed. The housing 11 has an air inlet 11*a* that causes air to be brought into the housing 11 and an air outlet 11*b* that causes the air to be brought out from the housing 11. In the housing 11, a flow passage is provided such that it extends from the air inlet 11*a* to the air outlet 11*b* of the housing 11. In this flow passage, the centrifugal fan 1 is arranged on an upstream side, and the heat exchanger 12 is arranged on a downstream side. The partition plate 13 has an opening 13*a* through which a discharge portion 42 (described later) passes. The discharge portion 42 is fitted into the opening 13*a* tightly without gaps, whereby the air sent from the centrifugal fan 1 passes through the heat exchanger 12 without fail.

Hereinbelow, the structure of the centrifugal fan 1 will be explained.

(Fan 2)

A fan 2 is driven to rotate by a motor or other devices (not illustrated) to forcibly send air outward in the radial direction by centrifugal force generated by the rotation. As illustrated in FIG. 1, the fan 2 has a disk-shaped main plate 2*a* and a ring-shaped side plate (not illustrated) facing each other in the direction of the rotational axis RS, and a plurality of blades 2*d* arranged between the main plate 2*a* and the side plate. The blades 2*d* are arranged at equal intervals in the circumferential direction around the rotational axis RS of the fan 2. The main plate 2*a* need only to be plate-shaped, and may have a shape other than a disk, such as a polygonal shape, for example. At the center of the main plate 2*a*, a shaft 2*b* to which a motor (not illustrated) is connected is provided. The main plate 2*a* is driven to rotate by a motor via the shaft 2*b*.

As illustrated in FIG. 1, the fan 2 has a cylindrical shape and includes the main plate 2*a*, the side plate and a plurality of blades 2*d*, and has a configuration in which one end portion in the direction of the rotational axis RS (lower part in FIG. 1) is blocked by the main plate 2*a*, and the other end portion (upper part in FIG. 1) is open. The open end of this cylindrical shape serves as a suction port 2*e* for suctioning air into the cylindrical space, i.e., into the fan 2.

The fan 2 is driven to rotate by a motor (not illustrated), and rotates around the rotational axis RS. As the fan 2 rotates, a gas outside the centrifugal fan 1 flows along a bell mouth 3 (described later), passes through the suction port 2*e* in the scroll casing 4 and a suction port 2*e* in the fan 2, and then is sucked into the fan 2. The air sucked into the fan 2 passes between a blade 2*d* and an adjacent blade 2*d* and is then sent outward in the radial direction.

(Scroll Casing 4)

The scroll casing 4 accommodates the fan 2 in its inside, as illustrated in FIG. 1. The scroll casing 4 rectifies the air blown out from the fan 2. Although the scroll casing 4 is made of a resin, a material for the scroll casing 4 is not limited to a resin. The scroll casing 4 has the scroll portion 41, a discharge portion 42, and a tongue portion 44. The scrod portion 41 is a portion that accommodates the fan 2 and guides the airflow generated by the fan 2 in a spiral shape. The discharge portion 42 is formed at a winding end portion 41*b* of the scroll portion 41, and includes a discharge port 43 configured to discharge airflow. The tongue portion 44 is a portion provided at a position where a winding start portion 41*a* of the scroll portion 41 and the discharge portion 42 are connected. Hereinbelow, each of the scrod portion 41, the discharge portion 42 and the tongue portion 44 will be explained in detail, (Scroll Portion 41)

The scroll portion 41 forms a flow passage that converts a dynamic pressure of the airflow generated by the fan 2 into a static pressure. The scroll portion 41 includes two side walls 4*a* arranged so as to face each other in the rotational axis RS direction of the shaft 2*b* and cover the fan 2 from both sides in the rotational axis RS direction, and a circumferential wall 4*c* that encloses the fan 2 in a radial direction of the rotational axis RS. The radial direction of the rotational axis RS is a direction perpendicular to the rotational axis RS. An interior space of the scroll portion 41, which is formed by the side wall 4*a* and the circumferential wall 4*c*, is a space that allows air blown out from the fan 2 to flow along the circumferential wall 4*c*.

(Side Walls 4*a*)

As illustrated in FIGS. 1 and 2, one of the two side walls 4*a* has a suction port 5 configured to suck air so that air can circulate between the fan 2 and the outside of the scroll casing 4. The suction port 5 is circularly shaped, and the fan 2 is arranged such that the center of the suction port 5 and the center of the shaft 2*b* of the fan 2 are almost aligned. The shape of the suction port 5 is not limited to a circular shape, but may be other shapes, such as an oval shape, for example.

One of the side walls 4*a* is provided with the bell mouth 3. The bell mouth 3 serves to rectify the gas to be sucked into the fan 2 and sends the gas into the suction port 2*e* of the fan 2. The bell mouth 3 is formed such that a diameter of its opening gradually decreases from the outside to the inside of the scroll casing 4. Of the opening of the bell mouth 3, a portion with the smallest diameter serves as the suction port 5. Air in the vicinity of the suction port 5 flows smoothly along the bell mouth 3 and also flows efficiently from the suction port 5 into the fan 2. The bell mouth 3 is either integrally molded with the side wall 4*a* or attached to the side wall 4*a* as a separate component. The configuration and the form of the bell mouth 3 are not particularly restricted.

(Circumferential Wall 4*c*)

The circumferential wall 4*c* is a wall provided between side walls 4*a* facing each other. The circumferential wall 4*c* causes the airflow generated by the fan 2 to flow along its curved wall surface and guides the airflow to the discharge port 43 via the scroll portion 41. The circumferential wall 4*c* is, for example, positioned parallel to the axial direction of the rotational axis RS of the fan 2 and covers the fan 2. The circumferential wall 4*c* covers the fan 2 from the radial direction relative to the rotational axis RS and forms an inner circumferential surface that faces the plurality of blades 2*d*.

The circumferential wall 4*c* is formed in a spiral shape in the direction of rotation R (see FIG. 2) of the fan 2. The circumferential wall 4*c* is provided so as to extend, along the direction of rotation R of the fan 2, from the winding start portion 41*a*, which is located at a boundary between the circumferential wall 4*c* and the tongue portion 44 to the winding end portion 41*b*, which is located at a boundary between the discharge portion 42 located away from the tongue portion 44 and the scroll portion 41. The winding start portion 41*a* is, in the circumferential wall 4*c*, an end portion on the upstream side of the airflow generated by the rotation of the fan 2. The winding end portion 41*b* is, in the circumferential wall 4*c*, an end portion on the downstream side of the airflow generated by the rotation of the fan 2.

The spiral shape of the circumferential wall 4*c* is, for example, a logarithmic spiral, an Archimedes spiral, or a spiral shape based on an involute curve, etc. An inner surface of the circumferential wall 4*c* forms a smoothly curved surface along the circumferential direction to the fan 2 from the winding start portion 41*a*, which is the beginning of the spirally-shaped winding, to the winding end portion 41*b*, which is the end of the spirally-shaped winding. Due to such a configuration, the air delivered from the fan 2 smoothly flows through the flow passage formed between the fan 2 and the circumferential wall 4*c* in the direction to the discharge portion 42. Therefore, the static pressure of the air in the scroll casing 4 increases efficiently from the tongue portion 44 to the discharge portion 42.

(Discharge Portion 42)

The discharge portion 42 has the discharge port 43 through which the airflow passing through the scroll portion 41 is discharged by the rotation of the fan 2. The discharge port 43 is an opening on the downstream side of the discharge portion 42. The discharge portion 42 is a hollow tube with a rectangular cross section crossing orthogonally to the direction of air flowing along the circumferential wall 4*c*. The discharge portion 42 forms a flow passage 45 configured to guide air that is sent from the fan 2 and flows in a gap between the circumferential wall 4*c* and the fan 2 to be discharged to the outside of the scroll casing 4, The cross-sectional area of this flow passage 45 increases from upstream to downstream.

The discharge portion 42 has an extended plate 42*a*, a diffuser plate 42*b*, a first side wall 42*c*, and a second side wall 42*d*. The extended plate 42*a* is formed so as to extend from the winding end portion 41*b* of the circumferential wall 4*c*, and is a plate-like portion formed as an integral part of the circumferential wall 4*c*. The diffuser plate 42*b* is formed integrally with the tongue portion 44 of the scroll casing 4 and is a plate-like portion provided so as to face the extended plate 42*a*. The diffuser plate 42*b* is formed such that it is angled relative to the extended plate 42*a* in such a manner that the cross-sectional area of the flow passage gradually increases along the direction of flow of air in the discharge portion 42.

The extended plate 42*a* and the diffuser plate 42*b* are formed between the first sidewall 42*c* and the second side wall 42*d*. Thus, due to the extended plate 42*a*, the diffuser plate 42*b*, the first side wall 42*c*, and the second side wall 42*d*, the discharge port 42 is formed as the flow passage 45 with a rectangular cross-sectional shape.

(Tongue Portion 44)

The tongue portion 44 is formed of a curved surface having a set radius of curvature, and smoothly connects the winding start portion 41*a* of the circumferential wall 4*c* with the discharge portion 42, The tongue portion 44 is a throttling portion necessary to blow out air sucked from the suction port 5 in a centrifugal direction and rises the pressure thereof. The tongue portion 44 inhibits the inflow of air from the end of winding to the start of winding of the spirally-shaped flow passage formed in the scroll casing 4.

[Operation of Air-Conditioning Apparatus]

When the fan 2 accommodated in the scroll casing 4 rotates, air is sucked into the housing from the air inlet 11*a* of the housing 11. The air sucked into the housing 11 flows into the fan 2 along the bell mouth 3 which forms the suction port 2*e* of scroll casing 4. The air flowing into the fan 2 is blown out outwardly in the radial direction of the fan 2. The air blown out from the fan 2 rises in pressure by passing through discharge portion 42 of which the cross-sectional area of the flow passage expands from the upstream side to the downstream side. After being discharged from the discharge port 43, the air of which the pressure has risen is supplied to the heat exchanger 12. The air that has supplied to the heat exchanger 12 exchanges heat with a heat exchange medium such as refrigerant flowing inside the heat exchanger 12 when passing through the heat exchanger 12, and the temperature and humidity thereof are adjusted. The air that has passed through the heat exchanger 12 is blown out from the air outlet 11*b* of the housing 11 to a space to be air-conditioned.

(Pressure Rising Effect and Drift Flow Suppression Effect)

The scroll casing 4 of Embodiment 1 has a configuration that is capable of obtaining a pressure rising effect and a drift flow suppression effect. The specific configuration that realizes these effects will be described below with reference to FIGS. 1 and 2, as well as FIG. 3, which is given after FIGS. 1 and 2.

Figure 3:
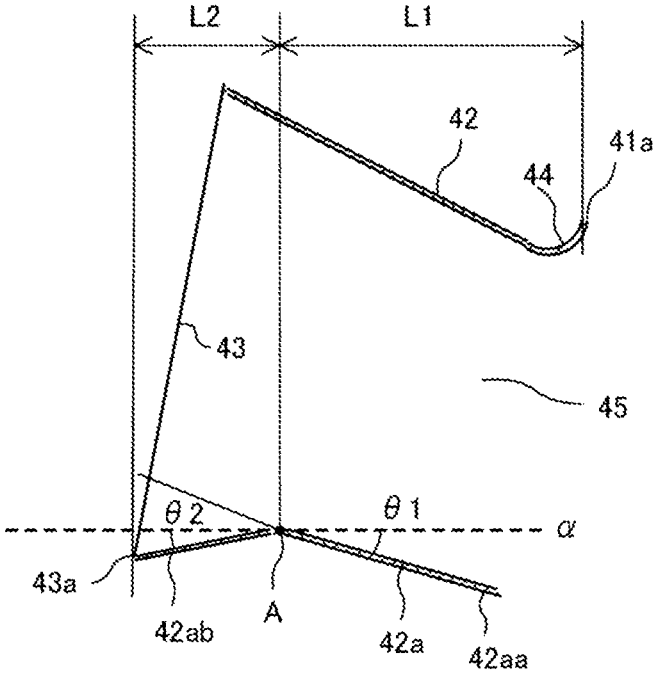
FIG. 3 is a cross-sectional view of the discharge portion of the scroll casing of the centrifugal fan according to Embodiment 1 and its surroundings.

FIG. 3 is a cross-sectional view of the discharge portion of the scroll casing of the centrifugal fan according to Embodiment 1 and its surroundings.

First, the configuration of the scroll casing 4, which provides a pressure rising effect and a drift flow suppression effect, is explained.

As illustrated in FIGS. 1 to 3, the discharge portion 42 of the scroll casing 4 has a flow passage cross-sectional area, that is, an area of a cross section crossing orthogonally to the direction of air flowing through the discharge portion 42, gradually enlarges from upstream to downstream. The discharge portion 42 of the scroll casing 4 has two levels of enlargement ratio. As illustrated in FIG. 3, the extended plate 42*a* of the discharge portion 42 is inclined relative to an inner wall surface 11*c* of the housing 11 (see FIG. 2) in a cross-section obtained by cutting the extended plate 42*a* in a thickness direction thereof, and has a change point A that allows the enlargement ratio to change by changing the degree of inclination of the extended plate 42*a*. The enlargement ratio is large in a portion on the downstream side of the change point A as compared with a portion on the upstream side of the change point A. Hereafter, in the extended plate 42*a*, the portion on the upstream side of the change point A is referred to as a first portion 42*aa*, and the portion on the downstream side of the change point A is referred to as a second portion 42*ab*. Note that the inner wall 11*c* of the housing 11 is a flat surface.

A virtual line parallel to the inner wall 11*c* of housing 11 (see FIG. 2) and passing through the change point A is defined as α. An angle formed by the virtual line α and the first portion 42*aa* of the discharge portion 42 is defined as θ1, and the angle formed by the virtual line α and the second portion 42*ab* of the discharge portion 42 is defined as θ2. Here, the angle θ1 and the angle θ2 satisfy the following relationship.

Specifically, the angle θ1 and the angle θ2 satisfy a relationship of either $0 \leq \theta 2 < \theta 1$ or $0 < \theta 2 \leq \theta 1$.

With the above-mentioned relationship of θ1 and θ2, the flow passage 45 in the discharge portion 42 enlarges in two stages. As a result, separation of the airflow flowing along the inner wall surface of the second portion 42*ab* of the discharge portion 42 can be suppressed, whereby a pressure rising effect can be obtained. In addition, because the airflow sticks to the inner wall surface of the second portion 42*ab*, a cross-sectional area of a passage through which airflow passes is expanded, whereby drift flow of air passing through the heat exchanger 12 can be suppressed. As a result, heat exchange in the heat exchanger 12 can be performed efficiently.

(Improvement in Workability in Assembly)

The scroll casing 4 according to Embodiment 1 has a configuration that allows workability in assembly to be improved. Hereinbelow, a specific configuration that enables improvement in workability in assembly will be explained with reference to FIGS. 1 to 3.

As illustrated in FIG. 3, the scroll casing 4 satisfies a relationship of L2<L1. L1 is a distance in a direction parallel to a virtual line α between an end portion on the upstream side (same as the winding start portion 41*a* of the circumferential wall 4*c*) of the tongue portion 44 and the change point A. L2 is a distance in a direction parallel to the virtual line α between the change point A and an end portion on the downstream side of the second portion 42*ab* of the discharge portion 42.

Improvement in workability in assembly due to the relationship L2<L1 will be explained. Explanation will be made using a scroll casing having a relationship L2>L1 as a comparative example.

Figure 4:
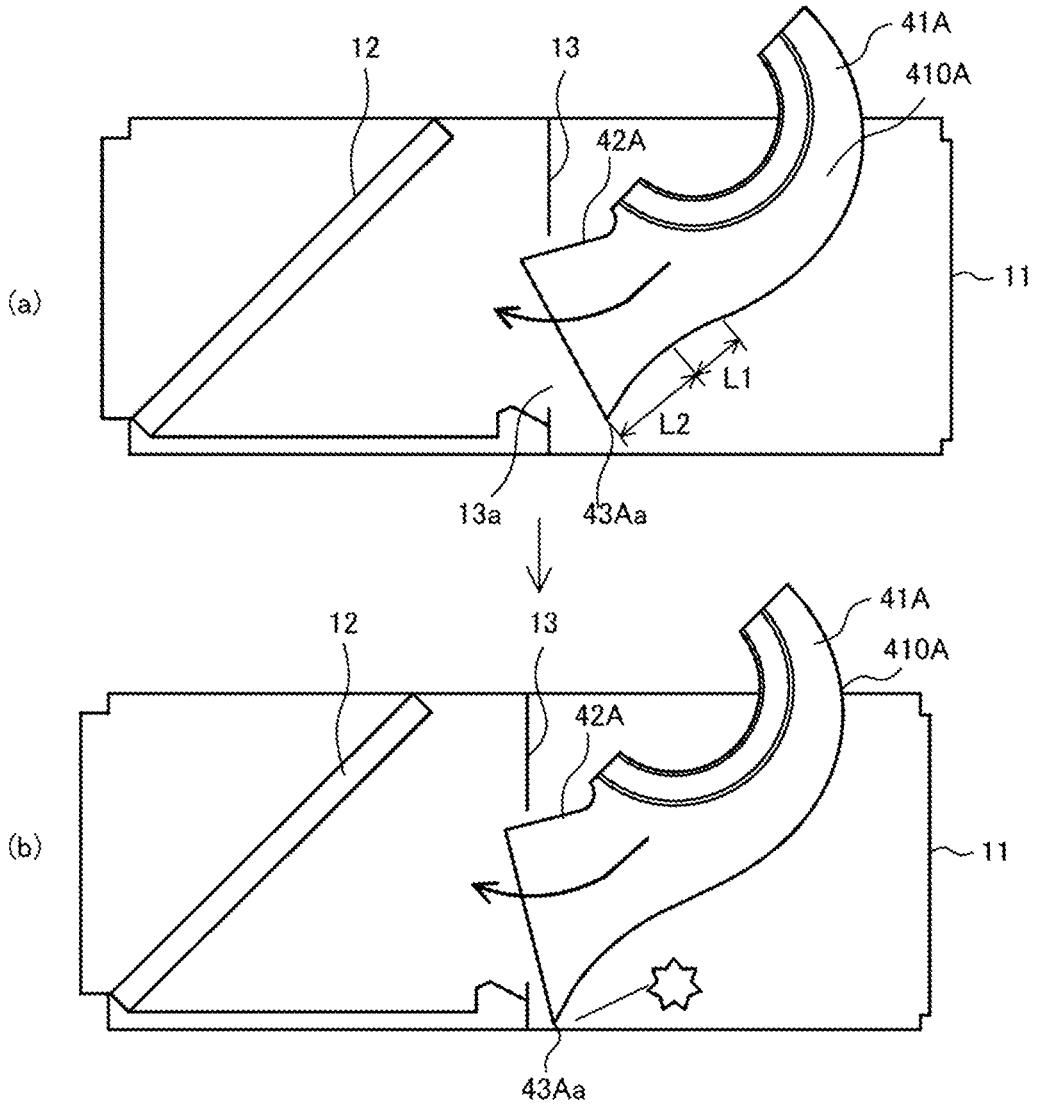
FIG. 4 Related Art
FIG. 4 is an assembly diagram explaining the assembly of the air-conditioning apparatus provided with a comparative scroll casing.
Figure 5:
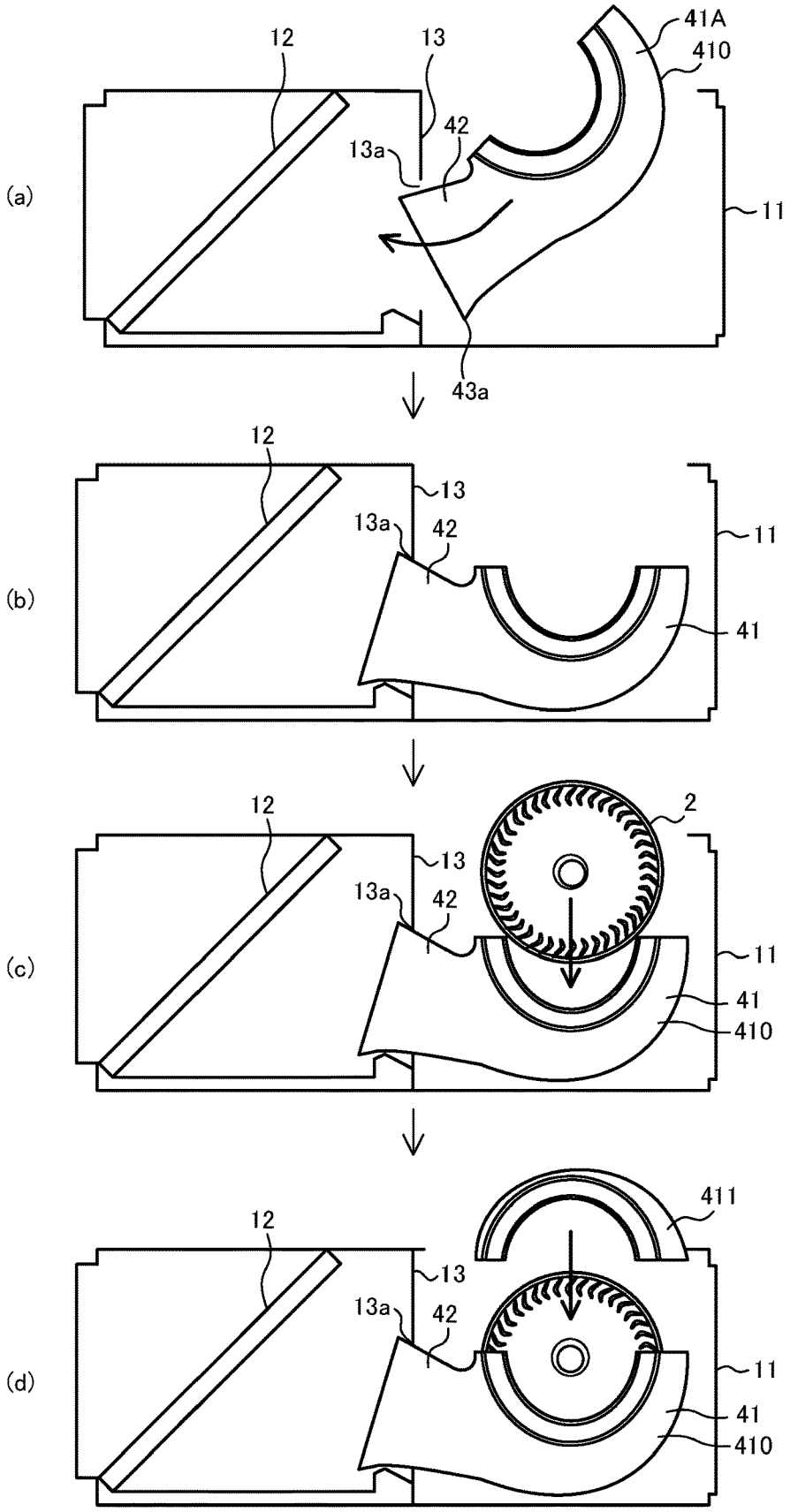
FIG. 5 is an assembly diagram explaining the assembly of an air-conditioning apparatus provided with the scroll casing according to Embodiment 1.

FIG. 4 is an assembly diagram explaining the assembly of an air-conditioning apparatus provided with a comparative scroll casing. FIG. 5 is an assembly diagram explaining the assembly of the air-conditioning apparatus provided with the scroll casing according to Embodiment 1. Although an explanation has not been made so far, the scroll casing is divided into an upper portion and a lower portion so as to include two portions, i.e., a first case portion having the discharge portion 42 and a second case portion.

In the comparative example, as illustrated in FIG. 4(*a*), a first case portion 410A of a scroll casing 41A is inserted into the housing 11, and a discharge portion 42A of the first case portion 410A is inserted toward the opening 13*a* of a partition plate 13 in a direction indicated by the arrow. At this time, if the relationship is L2>L1, as illustrated in FIG. 4(*b*), an end portion 43Aa on the downstream side of the first case portion 410A interferes with the housing 11.

To avoid such interference, it suffices that the opening 13*a* of the partition plate 13 be enlarged. However, if the opening 13*a* of the partition plate 13 is enlarged, in a state where the scroll casing 41A is installed in the housing 11, a gap is generated between the periphery of the opening 13*a* of the partition plate 13 and the outer circumference of the discharge portion 42A, and this gap is required to be closed with a separate component.

On the other hand, in the scroll casing 4 according to Embodiment 1, as shown in FIG. 5(*a*), a first case portion 410 of the scroll casing 4 is inserted into the housing 11, and the discharge portion 42 of the first case portion 410 is inserted in the direction shown by the arrow toward the opening 13*a* of the partition plate 13. At this time, in the scroll casing 4 of Embodiment 1, due to the relationship of L2≤L1, as illustrated in FIG. 5(*b*), the scroll casing 4 can be installed in the housing 11 without interference of the end portion 43*a* on the downstream side with the partition plate 13, thus facilitating assembly work.

The explanation on the assembly of the air-conditioning apparatus 10 is continued. Next, as illustrated in FIG. 5(*c*), the fan 2 is installed in the first case portion 410, and then, as illustrated in FIG. 5(*d*), a second case portion 411 is attached to the first case portion 410.

As described above, the scroll casing 4 of the centrifugal fan 1 according to Embodiment 1 accommodates the fan 2 that generates airflow, the scroll portion 41, which guides the airflow generated by the fan 2 in a spiral shape, the discharge portion 42, and the tongue portion 44. The discharge portion 42 is formed at the winding end portion 41*b* of the scroll portion 41 and has the discharge port 43 for discharging airflow. The tongue portion 44 is a portion formed at a position where the winding start portion 41*a* of the scroll portion 41 and the discharge portion 42 are connected. The discharge portion 42 forms a flow passage of which an area of a cross section crossing orthogonally to the flow direction of the airflow gradually enlarges toward the discharge port 43. The extended plate 42*a* formed so as to extend from the winding end portion 41*b* in the discharge portion 42 is, in a cross section obtained by cutting the extended plate 42*a* in a thickness direction thereof, inclined relative to the inner wall surface 11*c* of the housing 11 that accommodates the centrifugal fan 1. The extended plate 42*a* has the change point A at which an enlargement ratio of the area of the cross section on the downstream side becomes larger than that on the upstream side due to a change in the degree of inclination of the extended plate 42*a*. In the extended plate 42*a*, when a part on a side upstream than the change point A is named as the first portion 42*aa* and a part on a side downstream than the change point A is named as the second portion 42*ab*, the following relationship is satisfied. The angle θ1 and the angle θ2 satisfy a relationship of $0 < \theta 2 < \theta 1$, where θ1 is defined by the first portion 42*aa* and a virtual line that is parallel to the inner wall surface 11*c* of the housing 11 and passes the change point A, and the angle θ2 is defined by the second portion 42*ab* and the virtual line. The distance L1 and the distance L2 satisfy a relationship of L2<L1, where L1 is a distance in a direction parallel to the virtual line between an end portion on the upstream side of the tongue portion 44 and the change point A and the distance L2 is a distance in a direction parallel to the virtual line between the change point A and an end portion on the downstream side of the second portion 42*ab*. The centrifugal fan according to Embodiment 1 includes the scroll casing 4 and the fan 2 housed in the scroll casing 4.

Due to the relationship of $0<\theta 2<\theta 1$, a pressure rising effect and a drift flow suppression effect can be obtained. Further, due to the relationship of $L2<L1$, workability in assembly is improved.

The air-conditioning apparatus according to Embodiment 1 includes the centrifugal fan 1 mentioned above, the housing 11 that accommodates the centrifugal fan 1 and the heat exchanger 12 arranged on the discharge side of the centrifugal fan 1.

Due to the provision of the centrifugal fan 1 mentioned above, it is possible to obtain an air-conditioning apparatus capable of attaining both a pressure rising effect and a drift flow suppression effect, and also capable of improving workability in assembly.

Embodiment 2

Figure 6:
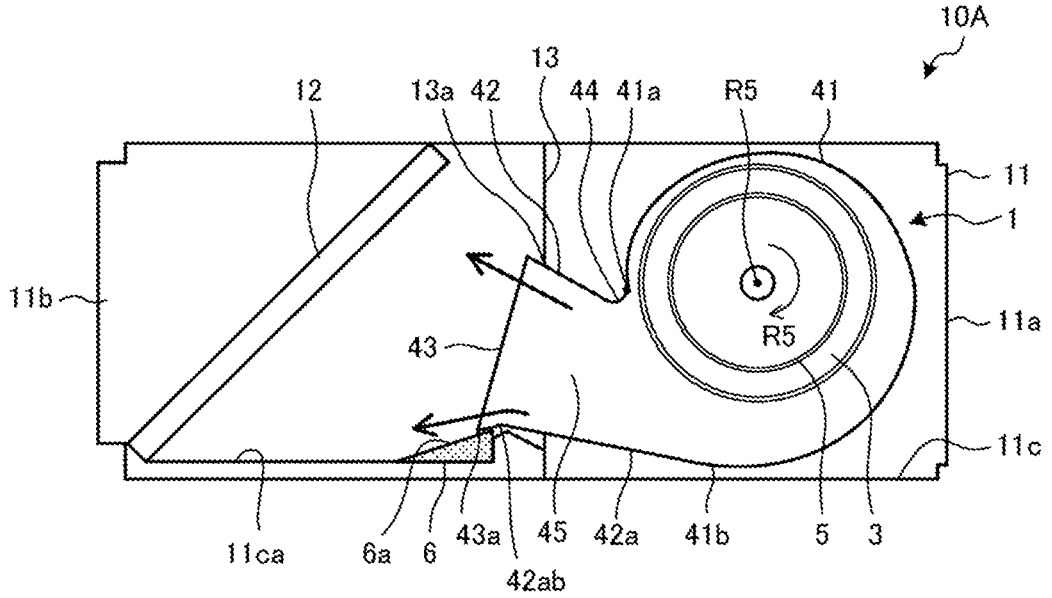
FIG. 6 is a schematic side view of an internal configuration of an air-conditioning apparatus according to Embodiment 2.

FIG. 6 is a schematic side view of an internal configuration of an air-conditioning apparatus according to Embodiment 2.

An air-conditioning apparatus 10A of Embodiment 2 is the same as the air-conditioning apparatus 10 of Embodiment 1, except that the air-conditioning apparatus 10A further has an air-guiding component 6. The air-guiding component 6 is a rod-shaped component and has a guide surface 6*a* that connects smoothly the end portion 43*a* on the downstream side of the second portion 42*ab* in the discharge portion 42 and a wall surface 11*ca*. The wall surface 11*ca* is, among the inner wall surface 11*c* of the housing 11, located on a portion an extended from the second portion 42*ab*. With this air-guiding component 6, the airflow discharged from the discharge port 43 is smoothly guided to the wall surface 11*ca* along the guide surface 6*a* of the air-guiding component 6 and then flows into the heat exchanger 12.

Thus, the airflow discharged from the discharge port 43 of the scroll casing 4 is smoothly guided to the heat exchanger 12. Hence, backflow of air that is generated, when the air-guiding component 6 is not provided, at a step formed between the end portion 43*a* on downstream side and the wall surface 11*ca* of the housing 11 can be suppressed. As a result, pressure rising and heat exchange by the heat exchanger 12 can be performed more efficiently.

The air-conditioning apparatus of Embodiment 2 has the same effect as that attained in Embodiment 1. In addition, due to the additional provision of the air-guiding component 6 in the air-conditioning apparatus according to Embodiment 1, the following advantageous effect can be obtained. Specifically, the airflow discharged from the discharge port 43 can be smoothly guided to the heat exchanger 12 along the guide surface 6*a* of the air-guiding component 6 through the wall surface 11*ca*, resulting in more efficient pressure rising and heat exchange in the heat exchanger 12.

Embodiment 3

Figure 7:
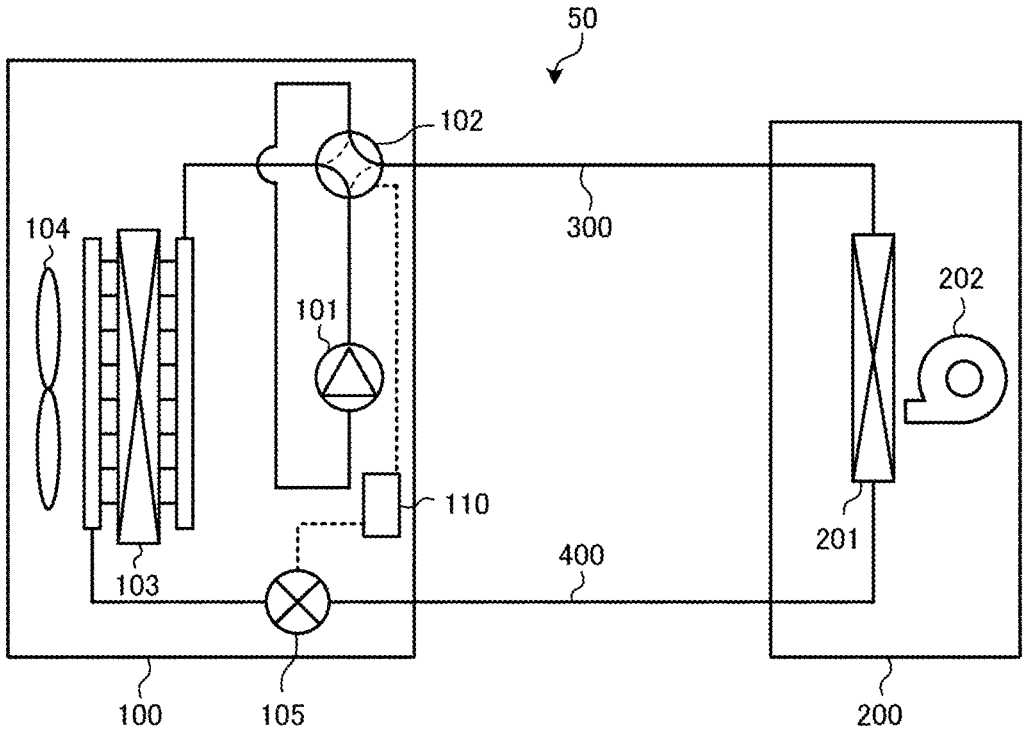
FIG. 7 is a diagram illustrating a configuration of a refrigeration cycle apparatus according to Embodiment 3.

FIG. 7 is a diagram illustrating a configuration of a refrigeration cycle apparatus according to Embodiment 3. As an indoor fan 202 of a refrigeration cycle apparatus 50 according to Embodiment 3, the centrifugal fan 1 is used. In the following description, a case in which the refrigeration cycle apparatus 50 is used for air-conditioning applications will be described, but the application of the refrigeration cycle apparatus is not limited to air conditioning. The refrigeration cycle apparatus 50 is used for refrigeration or air-conditioning applications, for example, used as refrigerators or freezers, vending machines, air-conditioning apparatus, refrigeration apparatuses, water heaters, etc.

The refrigeration cycle apparatus 50 according to Embodiment 3 performs air conditioning by heating or cooling an indoor space by transferring heat between outdoor air and indoor air via refrigerant. The refrigeration cycle apparatus 50 according to Embodiment 3 includes an outdoor unit 100 and an indoor unit 200. In the refrigeration cycle apparatus 50, the outdoor unit 100 and the indoor unit 200 are connected by a refrigerant pipe 300 and a refrigerant pipe 400 to form a refrigerant circuit through which refrigerant circulates. The refrigerant pipe 300 is a gas pipe through which gas-phase refrigerant flows, and the refrigerant pipe 400 is a liquid pipe through which liquid-phase refrigerant flows. Meanwhile, two-phase gas-liquid refrigerant is allowed to flow in the refrigerant pipe 400. In the refrigerant circuit of the refrigeration cycle apparatus 50, a compressor 101, a flow passage switching device 102, an outdoor heat exchanger 123, an expansion valve 105, and an indoor heat exchanger 201 are connected sequentially via the refrigerant pipes.

(Outdoor Unit 100)

The outdoor unit 100 includes the compressor 101, the flow passage switching device 102, the outdoor heat exchanger 123, and the expansion valve 105. The compressor 101 compresses sucked refrigerant and discharges the compressed refrigerant. The flow passage switching device 102 is a four-way valve, for example, by which the direction of the refrigerant flow passage is switched. The refrigeration cycle apparatus 50 switches the flow of refrigerant by using the flow passage switching device 102 in accordance with instructions from a controller 110, whereby heating operation or cooling operation can be realized.

The outdoor heat exchanger 123 causes heat exchange to be performed between refrigerant and outdoor air. The outdoor heat exchanger 123 functions as an evaporator during heating operation, and causes heat exchange to be performed between low-pressure refrigerant that flows in from the refrigerant pipe 400 and outdoor air, to thereby evaporate and vaporize refrigerant. The outdoor heat exchanger 123 functions as a condenser during cooling operation, and causes heat exchange to be performed between refrigerant that has been already compressed in the compressor 101 and has flowed in from the pipes near the flow passage switching device 102 and outdoor air, to thereby condense and liquefy refrigerant. The outdoor heat exchanger 123 is provided with an outdoor fan 104 to increase the efficiency of heat exchange between refrigerant and outdoor air. The outdoor fan 104 may be provided with an inverter device to vary an operating frequency of a fan motor, whereby the fan rotation speed may be changed. The expansion valve 105 is a throttle device. By adjusting the flow rate of refrigerant flowing through the expansion valve 105, the expansion valve 105 functions as an expansion valve, and by varying the degree of opening, the pressure of refrigerant is adjusted. For example, if the expansion valve 105 is an electronic expansion valve or the like, the degree of opening is adjusted in accordance with the instructions from the controller 110.

(Indoor Unit 200)

The indoor unit 200 has the indoor heat exchanger 201 that causes heat exchange to be performed between refrigerant and indoor air, and the indoor fan 202 that adjusts the flow of air with which the indoor heat exchanger 201 performs heat exchange. The indoor heat exchanger 201 functions as a condenser during heating operation, and causes heat exchange to be performed between refrigerant flowing in from the refrigerant pipe 300 and indoor air, to thereby condense and liquefy the refrigerant, and the refrigerant flows out toward the refrigerant pipe 400. The indoor heat exchanger 201 functions as an evaporator during cooling operation, and causes heat exchange to be performed between refrigerant brought into a low-pressure state by the expansion valve 105 and indoor air. The indoor heat exchanger 201 causes refrigerant to remove heat from the air to evaporate and gasify, and then to flow out toward the refrigerant pipe 300. The indoor fan 202 is located so as to face the indoor heat exchanger 201. For the indoor fan 202, one or more of the centrifugal fan 1 of Embodiment 1 and the centrifugal fan 1 of Embodiment 2 is applied. The operating speed of the indoor fan 202 is determined by user settings. The indoor fan 202 may be provided with an inverter device to vary the operating frequency of the fan motor (not illustrated) to change the rotation speed of the fan 2.

[Operation Example of Refrigeration Cycle Apparatus 50]

Next, cooling operation is described as an example of the operation of the refrigeration cycle apparatus 50. High-temperature and high-pressure gas refrigerant compressed and discharged by the compressor 101 flows into the outdoor heat exchanger 123 via the flow passage switching device 102. The gas refrigerant that flows into the outdoor heat exchanger 123 is condensed by heat exchange with outdoor air blown by the outdoor fan 104 to turn into low-temperature refrigerant, and flows out of the outdoor heat exchanger 123. Refrigerant that flows out of the outdoor heat exchanger 123 is expanded and depressurized by the expansion valve 105 to turn into low-temperature and low-pressure two-phase gas-liquid refrigerant. This two-phase gas-liquid refrigerant flows into the indoor heat exchanger 201 of the indoor unit 200, evaporates by heat exchange with indoor air blown by the indoor fan 202, and flows out of the indoor heat exchanger 201 as low-temperature and low-pressure gas refrigerant. At this time, the indoor air cooled by the heat absorbed by refrigerant is turned to be air for air conditioning, and is blown out from the discharge port of the indoor unit 200 into a space to be air-conditioned. The gas refrigerant that flows out of the indoor heat exchanger 201 is sucked into the compressor 101 via the flow passage switching device 102 and is compressed again. The above operation is repeated.

Next, heating operation is described as an example of the operation of the refrigeration cycle apparatus 50. High-temperature and high-pressure gas refrigerant compressed and discharged by the compressor 101 flows into the indoor heat exchanger 201 of the indoor unit 200 via the flow passage switching device 102. The gas refrigerant that flows into the indoor heat exchanger 201 is condensed by heat exchange with indoor air blown by the indoor fan 202 to turn into low-temperature refrigerant, and flows out of the indoor heat exchanger 201. At this time, the indoor air heated by the heat received from the gas refrigerant is turned to be air for air conditioning, and is blown out from the discharge port of the indoor unit 200 into a space to be air-conditioned. Refrigerant that flow out of the indoor heat exchanger 201 is expanded and depressurized by the expansion valve 105 to turn into low-temperature and low-pressure two-phase gas-liquid refrigerant. This two-phase gas-liquid refrigerant flows into the outdoor heat exchanger 123 of the outdoor unit 100, evaporates by heat exchange with outdoor air blown by the outdoor fan 104, and flows out of the outdoor heat exchanger 123 as low-temperature and low-pressure gas refrigerant. The gas refrigerant that flows out of the outdoor heat exchanger 123 is sucked into the compressor 101 via the flow passage switching device 102 and is compressed again. The above operation is repeated.

The refrigeration cycle apparatus 50 according to Embodiment 3 is provided with the centrifugal fan 1, etc. according to Embodiment 1, and hence the pressure of the airflow can be risen efficiently in the scroll portion 41 and heat exchange can be performed efficiently in the indoor heat exchanger 201.

The configurations described in the embodiments mentioned above are merely examples, and can be combined with other known technologies, and a part of the configurations can be omitted or changed to the extent that such omission or change do not to depart from the gist of the present disclosure.

REFERENCE SIGNS LIST

1: centrifugal fan, 2: fan, 2*a*: main plate, 2*b*: shaft, 2*d*: blade, 2*e*: suction port, 3: bell mouth, 4: scroll casing, 4*a*: side wall, 4*c*: circumferential wall, 5: suction port, 6: air-guiding component, 6*a*: guide surface, 10: air-conditioning apparatus, 10A: air-conditioning apparatus, 11: housing, 11*a*: air-inlet, 11*b*: air-outlet, 11*c*: inner wall surface, lice: wall surface, 12: heat exchanger, 13: partition plate, 13*a*: opening, 41: scroll portion, 41A: scroll casing, 41*a*: winding start portion, 41*b*: winding end portion, 42: discharge portion, 42A: discharge portion, 42*a*: extended plate, 42*aa*: first portion, 42*ab*: second portion, 42*b*: diffuser plate, 42*c*: first side wall, 42*d*: second side wall, 43: discharge port, 43Aa: end portion on the downstream side, 43*a*: end portion on the downstream side, 44: tongue portion, 45: flow passage, 50: refrigeration cycle apparatus, 100: outdoor unit, 101: compressor, 102: flow passage switching device, 104: outdoor fan, 105: expansion valve, 110: controller, 123: outdoor heat exchanger, 200: indoor unit, 201: indoor heat exchanger, 202: indoor fan, 300: refrigerant pipe, 400: refrigerant pipe, 410: first case portion, 410A: first case portion, 411: second case portion

The invention claimed is:

1. A refrigeration cycle apparatus provided with a centrifugal fan having a scroll casing and a fan accommodated in the scroll casing and configured to generate airflow, the refrigeration cycle apparatus comprising:

a housing that accommodates the centrifugal fan; and a heat exchanger arranged on a discharge side of the centrifugal fan, wherein the scroll casing includes a scroll portion configured to accommodate the fan and guide an airflow generated by the fan in a spiral shape;

a discharge portion provided at a winding end portion of the scroll portion and having a discharge port configured to cause airflow to be discharged; and a tongue portion provided at a part connecting a winding start portion of the scroll portion and the discharge portion, wherein the discharge portion forms a flow passage of which an area of a cross section crossing orthogonally to a flow direction of the airflow gradually enlarges toward the discharge port, the discharge portion has an extended plate, the extended plate is formed so as to extend from the winding end portion and is inclined, in a cross section perpendicular to a rotational axis of the fan, relative to an inner wall surface facing the extended plate among inner wall surfaces of the housing configured to accommodate the centrifugal fan, and the extended plate has a change point at which an enlargement ratio of the area of the cross section on a downstream side is increased so as to be larger than that on an upstream side due to a change in degree of inclination, and wherein, when a portion on the upstream side of the change point is named as a first portion and a portion on the downstream side of the change point is named as a second portion, an angle $\theta 1$ and an angle $\theta 2$ satisfy a relationship of either $0 \leq \theta 2 < \theta 1$ or $0 < \theta 2 \leq \theta 1$, where $\theta 1$ is defined by the first portion and a virtual line that is parallel to the inner wall surface of the housing and passes the change point, and the angle $\theta 2$ is defined by the second portion and the virtual line, and a distance L1 and a distance L2 satisfy a relationship of $L2 < L1$, where L1 is a distance in a direction parallel to the virtual line between an end portion on the upstream side of the tongue portion and the change point and the distance L2 is a distance in a direction parallel to the virtual line between the change point and an end portion on the downstream side of the second portion.

2. The refrigeration cycle apparatus of claim 1, further comprising a wind-guiding component that has a guide surface connecting smoothly an end portion on the downstream side of the second portion of the discharge portion and a portion of the inner wall surface located downstream of the second portion.

* * * * *